US010099082B2

(12) United States Patent
Kravchenko

(10) Patent No.: US 10,099,082 B2
(45) Date of Patent: Oct. 16, 2018

(54) LEG LIFT DUMBBELL

(71) Applicant: Alina Kravchenko, Houston, TX (US)

(72) Inventor: Alina Kravchenko, Houston, TX (US)

( * ) Notice: Subject to any disclaimer, the term of this patent is extended or adjusted under 35 U.S.C. 154(b) by 0 days.

(21) Appl. No.: 15/378,502

(22) Filed: Dec. 14, 2016

(65) Prior Publication Data

US 2017/0087407 A1 Mar. 30, 2017

Related U.S. Application Data

(60) Provisional application No. 62/266,993, filed on Dec. 14, 2015.

(51) Int. Cl.

| | |
|---|---|
| ***A63B 21/22*** | (2006.01) |
| ***A63B 21/075*** | (2006.01) |
| ***A63B 21/072*** | (2006.01) |
| ***A63B 23/04*** | (2006.01) |
| ***A63B 21/00*** | (2006.01) |
| *A63B 71/06* | (2006.01) |
| *A63B 23/035* | (2006.01) |

(52) U.S. Cl.

CPC ..... *A63B 21/075* (2013.01); *A63B 21/0726* (2013.01); *A63B 21/4033* (2015.10); *A63B 23/0482* (2013.01); *A63B 21/0728* (2013.01); *A63B 23/03508* (2013.01); *A63B 71/0622* (2013.01); *A63B 2071/065* (2013.01); *A63B 2071/0625* (2013.01); *A63B 2071/0655* (2013.01); *A63B 2208/0219* (2013.01); *A63B 2209/08* (2013.01); *A63B 2220/17* (2013.01); *A63B 2220/40* (2013.01); *A63B 2225/09* (2013.01)

(58) Field of Classification Search

CPC ..... A63B 71/0054; A63B 21/0608; A63B 21/075; A63B 21/0602; A63B 21/06; A63B 21/0605; A63B 21/0726; A63B 21/0728; A63B 21/4033; A63B 2220/40; A63B 2220/17; A63B 2208/0219; A63B 2071/065; A63B 2071/0655; A63B 2071/0625; A63B 71/0622; A63B 23/03508; A63B 23/0482; A63B 2209/08; A63B 2225/09

See application file for complete search history.

(56) References Cited

U.S. PATENT DOCUMENTS 5,735,777 A 4/1998 Benoit
5,842,957 A * 12/1998 Wheeler ..... A63B 21/0602 482/106

(Continued)

*Primary Examiner* — Glenn Richman
(74) *Attorney, Agent, or Firm* — The Law Office of Scot S. Fagerland, PC

(57) ABSTRACT

The invention is a dumbbell adapted for lifting by the legs. In particular, it is designed to fit in the crook of the knee for exercises such as the kneeling dumbbell leg lift and the fire hydrant leg lift. The handle is offset from center, flush with the top of the weights to prevent the dumbbell from rolling down the calf. The weights are fixedly attached to the handle so they do not rotate. The weights have a horseshoe shape, elongated vertically so they do not slip off the leg, and flattened at the bottom for stability on the floor. The weights also taper inward at the base to hold the leg firmly. Options include an adjustable length handle, magnetic additional weights, a handle cushion, and an electronic user interface to adjust the number of reps and the rest period.

5 Claims, 12 Drawing Sheets

(56) References Cited

U.S. PATENT DOCUMENTS

| | | | | |
|---|---|---|---|---|
| 5,868,653 | A | 2/1999 | Klasen | |
| 6,083,144 | A * | 7/2000 | Towley, III | A63B 21/0605 482/107 |
| 6,224,517 | B1 * | 5/2001 | Dereszynski | A63B 21/0602 482/105 |
| 6,500,101 | B1 * | 12/2002 | Chen | A63B 21/072 482/107 |
| 6,730,004 | B2 * | 5/2004 | Selsam | A63B 21/06 206/501 |
| 7,785,239 | B2 | 8/2010 | Daniel | |
| 8,002,680 | B2 | 8/2011 | Crawford et al. | |
| 8,235,875 | B2 * | 8/2012 | Chen | A63B 21/0608 482/108 |
| 8,784,282 | B2 * | 7/2014 | Mandell | A63B 71/0054 482/105 |
| 8,888,668 | B2 * | 11/2014 | Delisle | A63B 21/075 482/108 |
| 9,022,906 | B1 * | 5/2015 | Nelson | A63B 21/075 482/106 |
| 9,126,072 | B2 | 9/2015 | Watterson | |
| 9,155,930 | B2 | 10/2015 | Adkins | |
| 9,616,273 | B2 * | 4/2017 | Chen | A63B 21/075 |
| 2013/0090212 | A1 | 4/2013 | Wang | |

* cited by examiner

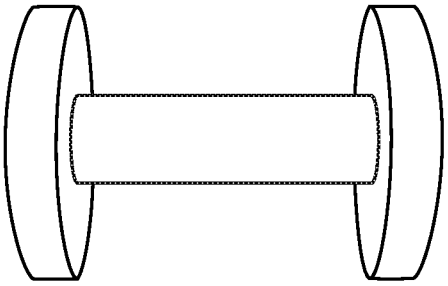
fig. 1: Prior Art
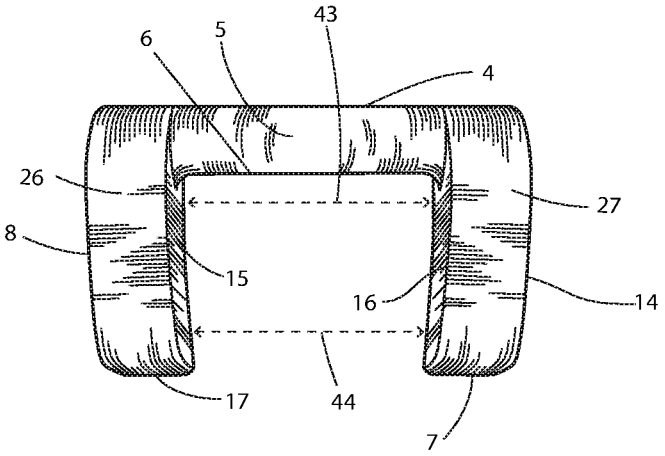
fig. 2

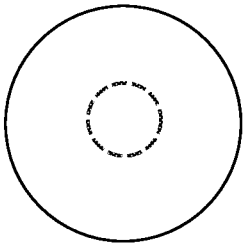
fig. 3: Prior Art
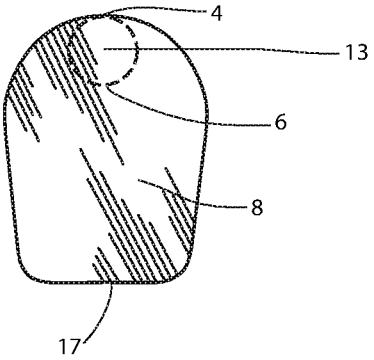
fig. 4

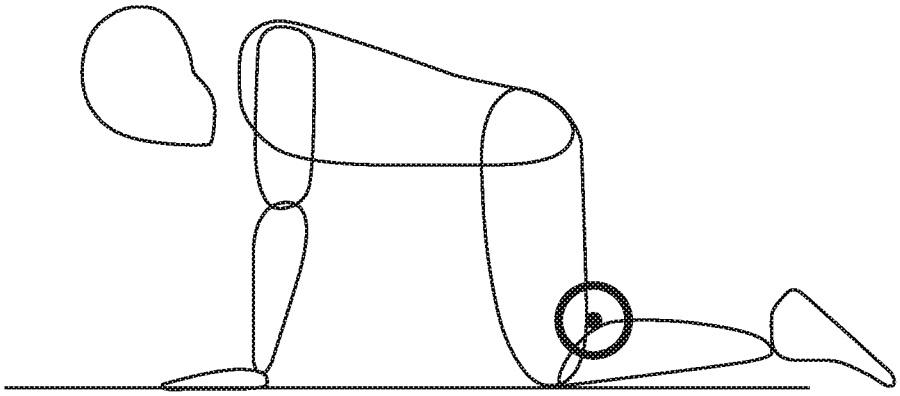
fig. 5: Prior Art
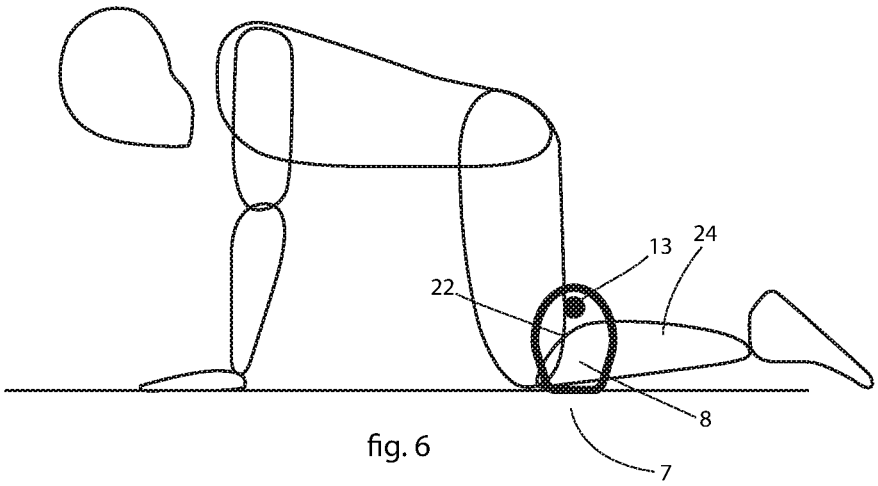
fig. 6

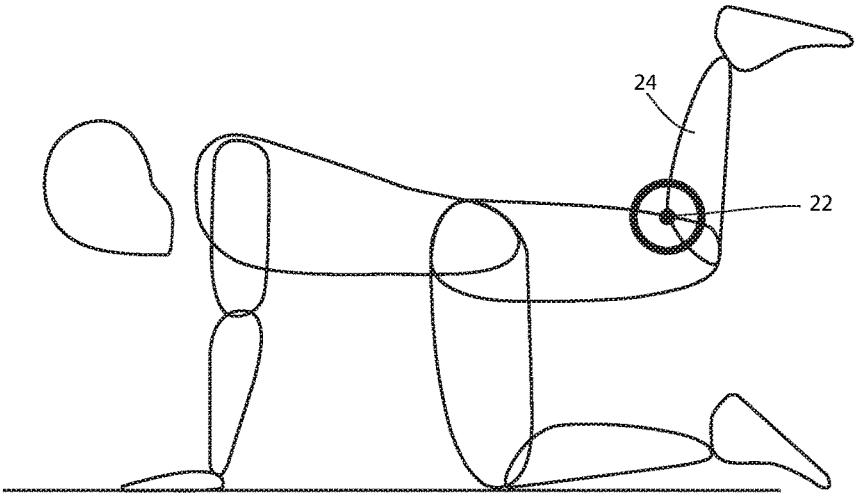
fig. 7: Prior Art
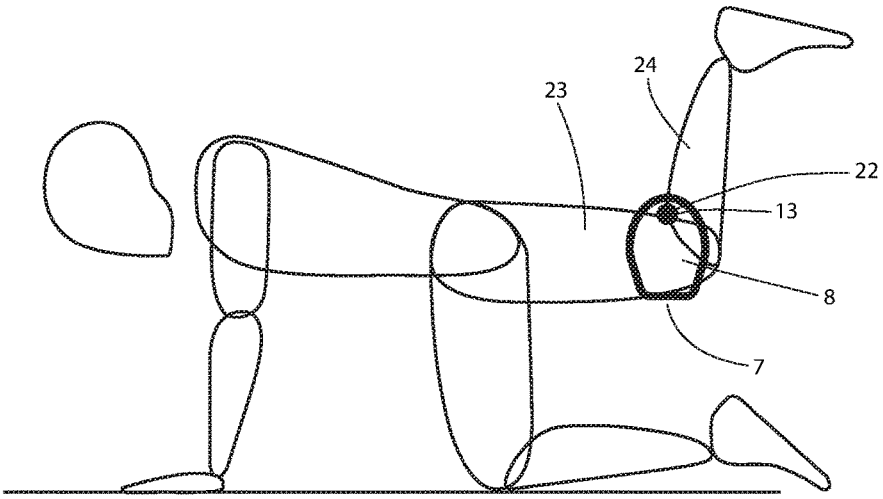
fig. 8

LEG LIFT DUMBBELL

RELATED APPLICATION

This application claims the priority of U.S. provisional patent application 62/266,993, filed on Dec. 14, 2015.

1. FIELD OF THE INVENTION

This invention is in the field of exercise devices.

2. DESCRIPTION OF RELATED TECHNOLOGY

Conventional dumbbells are designed for gripping and lifting by hand, and therefore they provide good exercise for the upper body. They are not ideally suited for lower body workouts.

One method of using a dumbbell in a leg workout is to squat or lunge with dumbbells in hand. The dumbbell squat provides additional resistance beyond the athlete's own body weight. Another method is the dumbbell-assisted leg curl. The leg curl is typically done on a bench in supine position. The legs are bent from the knee. When a dumbbell is used to assist a leg curl, it is generally held between the athlete's shoes. Since the dumbbell was designed for lifting by the hands, not the feet, it is an awkward tool for leg curls. It can easily slip and fall during exercise.

A third form of exercise is the "Kneeling Dumbbell Leg Lift", which works out the gluteus maximus and hamstring muscles. In this exercise, the athlete positions herself on hands and knees, with the dumbbell handle tucked into one popliteal fossa (the posterior surface of the knee). She then kicks back with her upper leg, raising her knee above the floor. See FIGS. 5-8 for reference. A related exercise is the "Fire Hydrant" leg lift. A conventional dumbbell is very awkward in these leg lifts. The dumbbell has a tendency to roll or slip off of the leg. This can not only make the exercise difficult and inefficient, but it can even cause minor injuries. Otherwise, the athlete must squeeze the dumbbell between the lower part of her hamstrings and the upper part of her calf muscles, which is inefficient for exercise and not even possible in a straight-leg lift.

Athletes need a dumbbell that is lifted directly by the legs. The ideal solution is a dumbbell ergonomically designed for lifting by the legs. It should not present any danger of rolling, slipping, or falling during exercise.

4. SUMMARY OF THE INVENTION

The leg lift dumbbell is a free-weight dumbbell adapted for use in leg exercises. The dumbbell's unique design allows the user to lift the dumbbell with the popliteal fossa while performing Kneeling Dumbbell Leg Lifts or Fire Hydrant Leg Lifts.

The dumbbell's handle is not coaxial with the centers of the weights, but rather offset toward the top of the dumbbell. This design keeps the dumbbell from rolling when it is positioned in the crook of the knee. The weights are more elongated than traditional round weights. For further stability, the weights are flattened on the bottom.

In a second embodiment of the invention, the dumbbell is ferromagnetic. Additional weights are then magnetically attached to the dumbbell, so that the exercise intensity is easily adjustable.

In a third embodiment of the invention, the magnetic weights are additionally secured to the dumbbell with tabs that fit into indentations.

In a fourth embodiment of the invention, the dumbbell electronically monitors the workout. A control panel allows the user to program the desired number of sets, repetitions per set, and rest periods. An accelerometer in the dumbbell senses each leg lift. When the desired number of repetitions is reached, or when the rest period is over, the dumbbell alerts the user with an auditory and/or haptic signal.

In a fifth embodiment of the invention, the length of the handle is adjustable, for optimal fit on the leg.

5. BRIEF DESCRIPTION OF THE DRAWINGS

FIG. 1 is a front plan view of the prior art conventional dumbbell.

FIG. 2 is a front plan view of the invention.

FIG. 3 is a left plan view of the prior art conventional dumbbell.

FIG. 4 is a left plan view of the invention. By symmetry, this view is identical to the right plan view.

FIG. 5 depicts the prior art conventional dumbbell being used for a leg lift, while the athlete's leg is in the lowered position.

FIG. 6 depicts the invention being used for a leg lift, while the athlete's leg is in the lowered position.

FIG. 7 depicts the prior art conventional dumbbell being used for a leg lift, while the athlete's leg is in the elevated position.

FIG. 8 depicts the invention being used for a leg lift, while the athlete's leg is in the elevated position.

Figure 18:
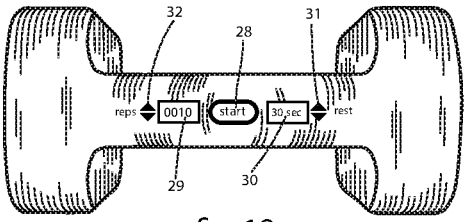
FIG. 18 is a top plan view of the leg lift dumbbell. This figure shows an embodiment with an electronic user interface.
Figure 19:
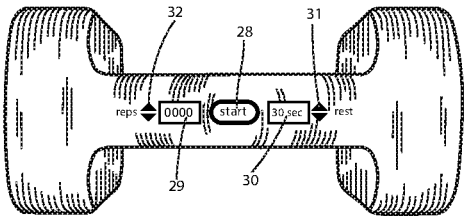

FIG. 19 presents the same view of the same embodiment as FIG. 18, this time with the electronic user interface displaying an expired rest period.

Figure 20:
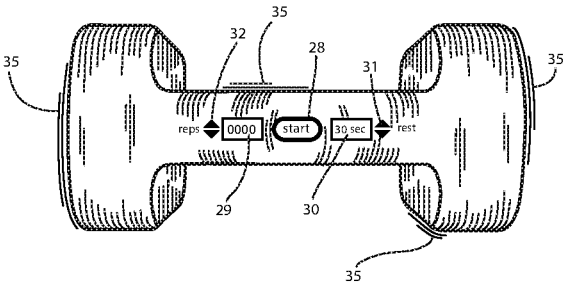

FIG. 20 presents the same view of the same embodiment as FIG. 19, this time with the electronic user interface alerting the user.

Figure 21:
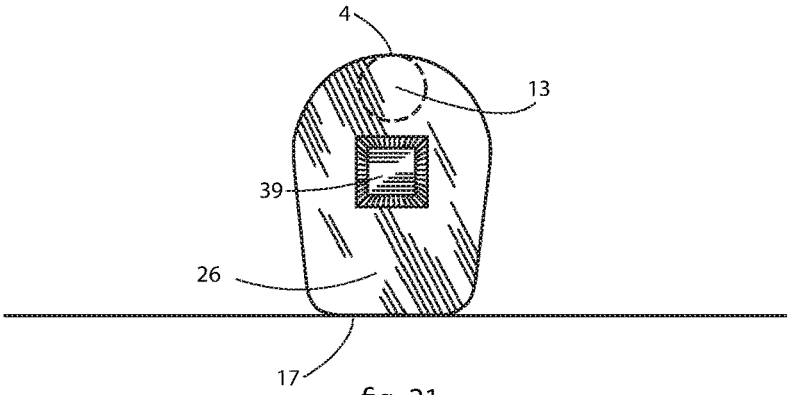

FIG. 21 is a left plan view of the invention, in an embodiment featuring an indentation.

Figure 22:
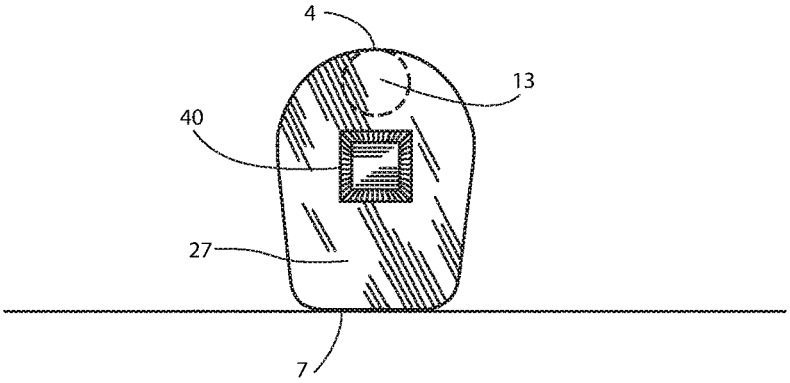

FIG. 22 is a right plan view of the invention, in an embodiment featuring an indentation.

Figure 23:
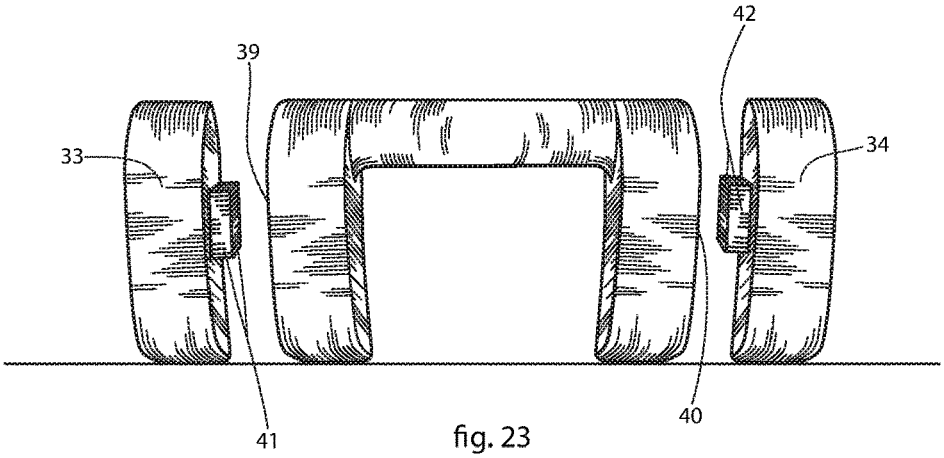

FIG. 23 is a front plan view of the invention, in an embodiment featuring tabs.

Figures 24, 25, 26, 27:
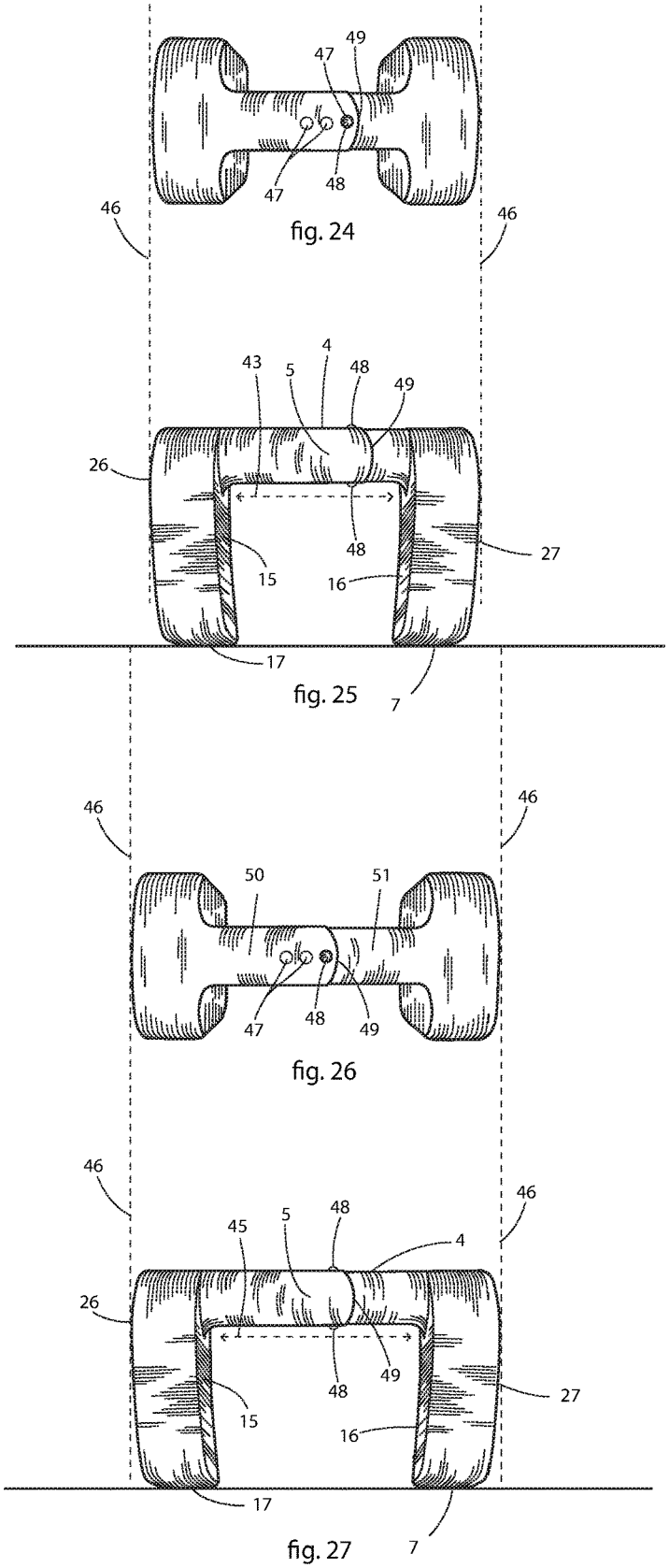

FIG. 24 is a top plan view of the invention, in an embodiment featuring an adjustable handle in a shortened position.

FIG. 25 is a front plan view of the invention, in an embodiment featuring an adjustable handle in a shortened position.

FIG. 26 is a top plan view of the invention, in an embodiment featuring an adjustable handle in an extended position.

FIG. 27 is a front plan view of the invention, in an embodiment featuring an adjustable handle in an extended position.

6. DETAILED DESCRIPTION

The invention is a dumbbell adapted for lifting by a leg. FIGS. 2, 4, 9, 13, and 14 depict the dumbbell and many of its primary features. The dumbbell includes a handle (5). The handle has a top part (4) and a bottom part (6). The handle is attached to a left weight (26) and a right weight (27). In the preferred embodiment, the handle, left weight, and right weight are all parts of one unitary construction, so that there are no gaps, joints, seams, or fasteners between them.

The top part of the handle is flush with the tops of the weights. This position is called the "offset handle" and is pointed out as feature 13 in FIG. 4. This contrasts with the design of a traditional dumbbell, shown in FIGS. 1 and 3. In a traditional dumbbell, the handle is coaxial with the weights. The offset handle makes the invention much easier to lift with a leg than a traditional dumbbell. The user can securely place the handle of the invention at the area behind the knee on the popliteal fossa (22) as shown in FIGS. 6 and 8. Because the handle is at the top of the weights, the dumbbell does not roll down the calf during exercise.

Figure 11:
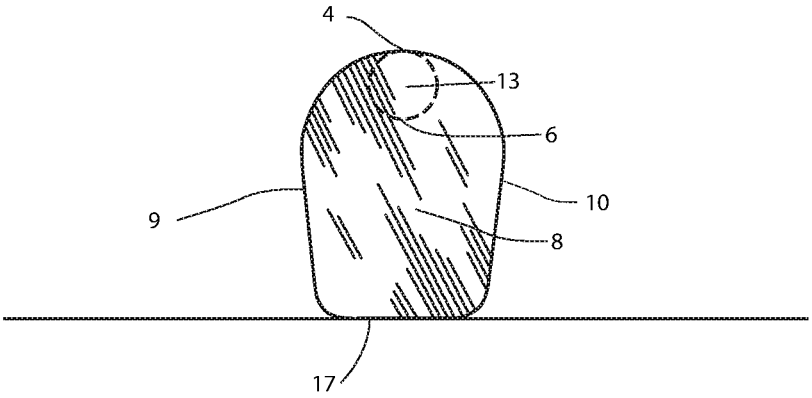
FIG. 11 is a left plan view of the invention with a different set of parts labeled than in FIG. 4.

The weights are adapted for optimal stability during exercise. Each weight has a horseshoe shaped profile as shown clearly in FIG. 11. It is vertically elongated to make maximal contact with the leg. In FIG. 11, the left weight is shown. This weight has a greater length from top (4) to bottom (7) than from front (10) to back (9). The right weight is not shown but it is symmetric to the left weight.

Figure 12:
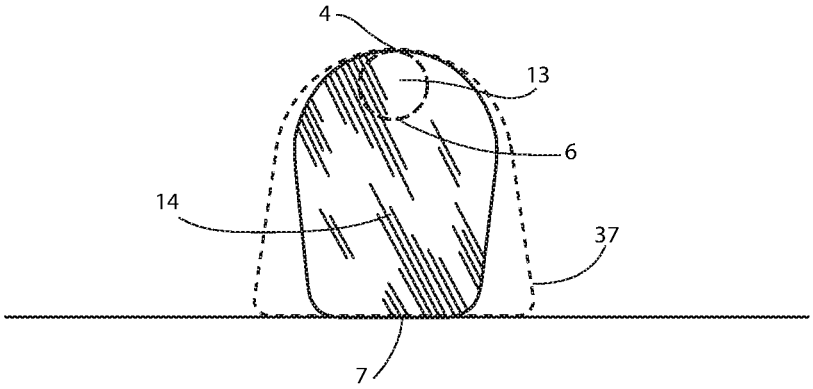
FIG. 12 is a right plan view of the invention showing a range of proportions for the profile of the weight.
Figure 13:
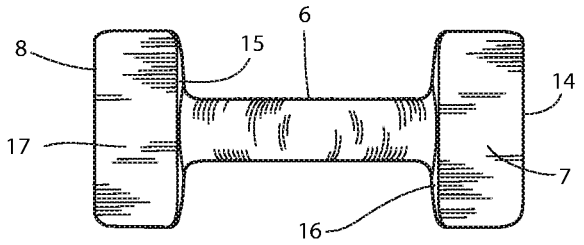
FIG. 13 is a bottom plan view of the invention.
Figure 14:
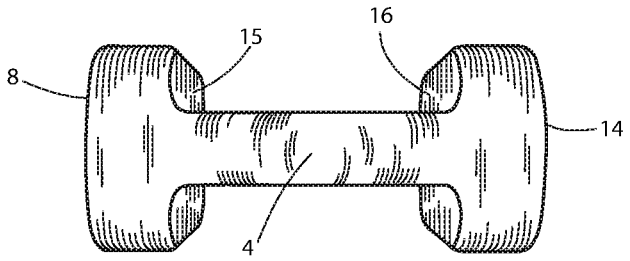
FIG. 14 is a top plan view of the invention.
Figure 15:
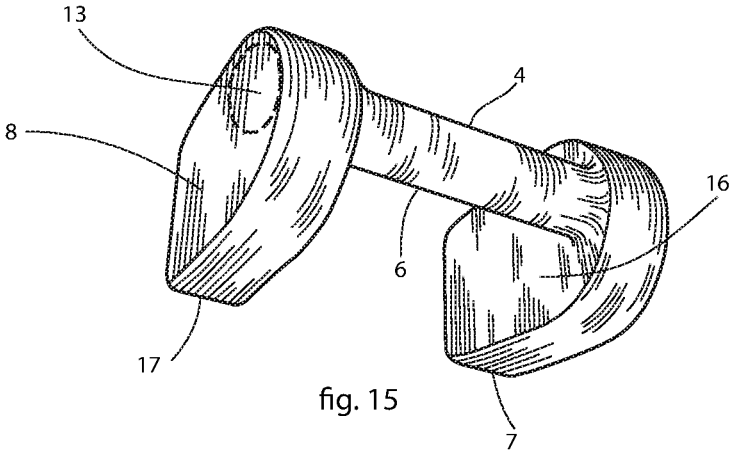
FIG. 15 is a perspective view of the invention.

The front and back surfaces of the weight can be tapered at the bottom, as shown in FIG. 11. They can alternatively be flared at the bottom, as shown by the alternative profile (37) in FIG. 12.

The two weights together hold the leg in a firm grip. Referring to FIG. 2, the weights are slightly tapered inwardly toward the bottom so that the length of the handle (43) is greater than the distance between the bottoms of the weights (44). The bottom of the left weight (17) and the bottom of the right weight (7) are flat so that the dumbbell rests securely upon the floor when the athlete's leg is in the lowered position. See FIG. 6. It is especially important for the dumbbell to grip the legs in the Fire Hydrant leg lift exercise. In this exercise, the leg is lifted outward from the body until it becomes parallel to the ground.

Figure 9:
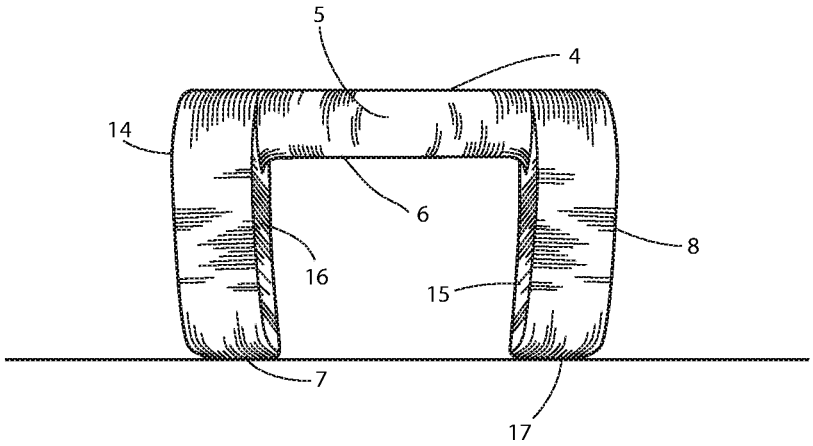
FIG. 9 is a back plan view of the invention.
Figure 10:
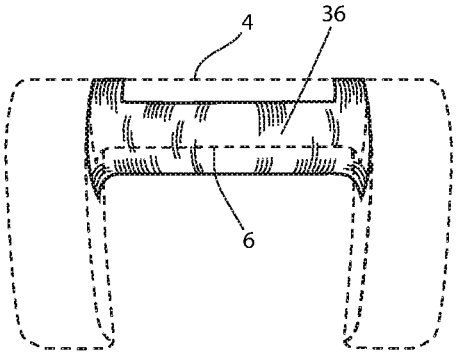
FIG. 10 is a front plan view of the invention showing the optional handle cushion.

For the user's comfort, a handle cushion (36) is available to place over the handle, as shown in FIG. 10. The user may exercise with or without the handle cushion. The cushion can be made of any soft material. It may be wrapped entirely around the handle (5) or may cover only the bottom part of the handle (6). It may be desirable to leave the top part of the handle (4) exposed, as the top part of the handle can have important features as disclosed in embodiments below.

A dumbbell with offset handle is disclosed in U.S. Pat. No. 9,155,930 (Adkins). This dumbbell is intended for lifting by hand. As such, it does not have any other design features to adapt it for leg lifts. The bottoms of the weights are rounded and the weights are not contoured to grip the legs. For these reasons, the present invention offers novel advantages over Adkins. Furthermore, Adkins describes a "kinetic" dumbbell, wherein the weights rotate freely about the handle axis. That feature would counteract stability. In the present invention, the weights are fixedly attached to the handle and do not rotate.

Figure 16:
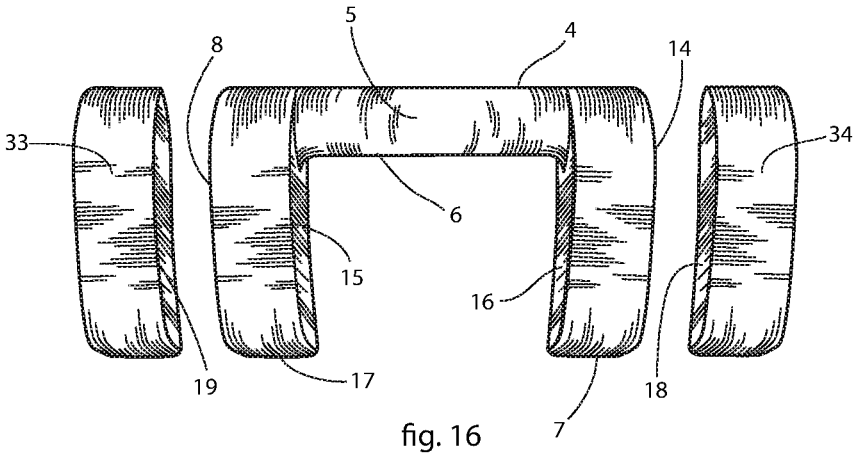
FIG. 16 is a front plan view of the invention with optional extra weights ready to be attached.
Figure 17:
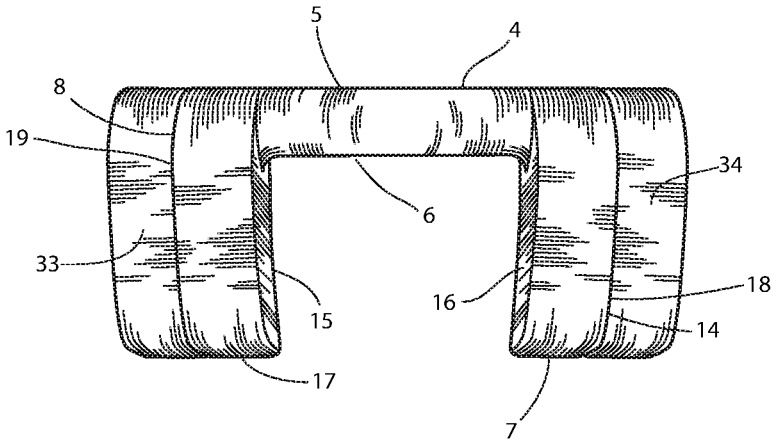
FIG. 17 is a front plan view of the invention with optional extra weights attached.

A second embodiment of the leg lift dumbbell allows the user to adjust the amount of weight with ease, as illustrated in FIGS. 16 and 17. The outside surface of the right weight (14) and the outside surface of the left weight (8) are made of a ferromagnetic material. This embodiment of the dumbbell has a left additional weight (33) and a right additional weight (34). The inside surface of the right additional weight (18) and the inside surface of the left additional weight (19) are made of ferromagnetic material, so that the left additional weight magnetically adheres to the left weight, and the right additional weight magnetically adheres to the right weight.

A third embodiment of the invention is shown in FIGS. 21-23. This embodiment has magnetic additional weights as in the second embodiment. In addition, there is a tab-and-indentation system to help keep the additional weights in place. FIG. 21 shows a left indentation (39) in the left weight (26). FIG. 22 shows a right indentation (40) in the right weight (27). FIG. 23 shows a left tab (41) on the left additional weight (33) and a right tab (42) on the right additional weight (34). The tabs of the additional weights fit into the indentations on the weights, helping to secure the additional weights to the dumbbell. These illustrations depict only one tab and indentation on each side of the weight. There may be multiple tabs and indentations on each side of the weight.

In a fourth embodiment of the invention, the handle (5) contains an electronic user interface and feedback system, shown in FIGS. 18-20. The user can preset the number of reps with up and down buttons to increase or decrease the number of reps (32). She can also preset the rest period between reps with up and down buttons to increase or decrease the time of rest (31). The number of reps remaining is displayed on the number of reps display (29), and the remaining rest period is displayed on the rest period display (30). An accelerometer (not shown) counts the number of repetitions that the dumbbell is raised and lowered. When the preset number of repetitions has been reached, the dumbbell vibrates to alert the user that the set is completed.

FIG. 18 shows the fourth embodiment of the dumbbell when the number of reps display (29) indicates that 10 reps remain. In FIG. 19, the number of reps display has counted down and shows that 0 reps remain. This triggers the activation system. FIG. 20 shows vibrations (35) alerting the user to stop lifting. In FIG. 20, the rest period display shows 30 seconds. The rest period display will then count down. When it reaches 0 seconds, the dumbbell will vibrate again, alerting the user to begin a new set of reps. The user interface will then reset and appear as in FIG. 18 once again.

A vibrating barbell was disclosed in U.S. Pat. No. 5,868,653 (Klasen), though this was for muscle therapy purposes, not to count reps.

A fifth embodiment of the invention is shown in FIGS. 24-27. This embodiment features an adjustable handle. The handle is formed from an outer handle (50) with a larger radius, and an inner handle (51) with a smaller radius. The inner handle slides securely into the outer handle. The handle seam (49) is the end of the outer handle, wherein the inner handle enters. The inner and outer handles are locked together with a locking mechanism. The figures show a locking mechanism in the form of a positional button (48) and holes (47). The positional button (48) fits into a hole (47) to lock the handle into position. If the user wishes to adjust the handle's length, she presses the positional button (48) with one hand and slides the inner handle (51) with the other hand, so that the positional button engages with a different hole. In FIGS. 24 and 25, the handle is set to a shorter length.

In FIGS. 26 and 27, the handle is set to a longer length, resulting in an expanded distance between the tops of the weights (26 and 27). The difference between the shorter length and the longer length is made more clear with measurement lines (46). The system of button and holes is only one way to adjust the length of the handle; any locking mechanism that obviously serves the same purpose is also within the scope of this invention.

This invention encompasses all possible combinations of the embodiments described above.

GLOSSARY OF PARTS

For clarity, the parts, dimensions, and features referred to in the figures are defined below.

Parts 1-3 have been omitted from this description.

Part 4 is the top of the handle (5).

Part 5 is the handle.

Part 6 is the bottom of the handle (5).

Part 7 is the bottom of the right weight (27).

Part 8 is the outside surface of the left weight (26).

Part 9 is the back surface of the left weight (26).

Part 10 is the front surface of the left weight (26).

Parts 11-12 have been omitted from this description.

Feature 13 is the offset position of the handle (5).

Part 14 is the outside surface of the right weight (27).

Part 15 is the inside surface of the left weight (26).

Part 16 is the inside surface of the right weight (27).

Part 17 is the bottom of the left weight (26).

Part 18 is the inside surface of the right additional weight (34).

Part 19 is the inside surface of the left additional weight (33).

Parts 20 and 21 have been omitted from this description.

Part 22 is the user's popliteal fossa.

Part 23 is the user's hamstring muscle.

Part 24 is the user's calf.

Part 25 has been omitted from this description.

Part 26 is the left weight.

Part 27 is the right weight. Parts 26 and 27 are referred to collectively as "the weights".

Part 28 is the start button.

Part 29 is the number of reps display.

Part 30 is the rest period display.

Part 31 is the up and down buttons to increase or decrease the time of rest.

Part 32 is the up and down buttons to increase or decrease the number of reps.

Part 33 is the left additional weight.

Part 34 is the right additional weight. Parts 33 and 34 are referred to collectively as "the additional weights".

Feature 35 is vibrations.

Part 36 is the handle cushion.

Feature 37 is an alternative profile of the weights (26 and 27).

Part 38 has been omitted from this description.

Part 39 is the left indentation in the left weight (26).

Part 40 is the right indentation in the right weight (27).

Part 41 is the left tab on the left additional weight (33).

Part 42 is the right tab on the right additional weight (34).

Measurement 43 is the length of the handle (5).

Measurement 44 is the distance between the bottoms of the weights (7 and 17).

Measurement 45 is the expanded distance between the tops of the weights (26 and 27).

Measurements 46 are measurement lines to compare the lengths of the dumbbell in shortened or lengthened handle positions.

Parts 47 are holes.

Part 48 is the positional button.

Part 49 is the handle seam.

Part 50 is the outer handle.

Part 51 is the inner handle.

I claim:

1. A dumbbell adapted for lifting by the legs, comprising
a handle, comprising a top and a bottom;
two weights, namely a left weight and a right weight, fixedly attached to the handle, each weight comprising a top, a bottom, a front, a back, an inner surface, and an outer surface;
wherein the top of the handle is flush with the top of the weights;
and wherein the weights are longer from top to bottom than from front to back;
and wherein the weights are flattened on the bottom;
and wherein the weights are tapered inwardly so that the distance between the inner surfaces of the weights increases from bottom to top.

2. The dumbbell of claim 1,
further comprising two additional weights, namely a left additional weight and a right additional weight, each additional weight comprising an inner surface;
wherein the outer surfaces of the weights are composed of a ferromagnetic material;
and wherein the inner surfaces of the additional weights are also composed of a ferromagnetic material;
whereby the additional weights are secured magnetically to the weights.

3. The dumbbell of claim 2,
further comprising an indentation on the outer surface of each weight;
further comprising a tab on the inner surface of each additional weight;
whereby the tabs of the additional weights fit into the indentations of the weights.

4. A dumbbell adapted for lifting by the legs, comprising:
a handle, comprising a top and a bottom;
two weights, namely a left weight and a right weight, fixedly attached to the handle, each weight comprising a top, a bottom, a front, a back, an inner surface, and an outer surface;
wherein the top of the handle is flush with the top of the weights;
and wherein the weights are longer from top to bottom than from front to back;
and wherein the weights are flattened on the bottom;
and wherein the weights are tapered inwardly so that the distance between the inner surfaces of the weights increases from bottom to top;
up and down buttons to increase or decrease the number of reps;
a number of reps display;
up and down buttons to increase or decrease the time of rest;
a rest period display;
an accelerometer to count the number of reps;
a signal to alert the user when the number of reps remaining reaches zero;
a signal to alert the user when the time of rest reaches zero.

5. A dumbbell adapted for lifting by the legs, comprising:
a handle, comprising a top and a bottom;

two weights, namely a left weight and a right weight, fixedly attached to the handle, each weight comprising a top, a bottom, a front, a back, an inner surface, and an outer surface;

wherein the top of the handle is flush with the top of the weights;

and wherein the weights are longer from top to bottom than from front to back;

and wherein the weights are flattened on the bottom;

and wherein the weights are tapered inwardly so that the distance between the inner surfaces of the weights increases from bottom to top;

wherein the handle comprises an inner handle and an outer handle, the inner handle coaxial with the outer handle;

wherein the end of the outer handle is a handle seam where the inner handle slides into the outer handle;

further comprising a locking mechanism to hold the inner handle and the outer handle together securely;

wherein the locking mechanism has multiple positions corresponding to multiple handle lengths.

* * * * *